US006041482A

United States Patent [19]

Zhu et al.

[11] Patent Number: 6,041,482

[45] Date of Patent: Mar. 28, 2000

[54] APPARATUS AND METHOD FOR SPREADING AND FLATTENING A TUBULAR FABRIC

[75] Inventors: Xuejian Zhu; Aiken Anderson Still, IV, both of Orangeburg County, S.C.

[73] Assignee: Mayer Industries, Orangeburg, S.C.

[21] Appl. No.: 09/322,334

[22] Filed: May 28, 1999

[51] Int. Cl.[7] ..... D06C 5/00

[52] U.S. Cl. ..... 26/80; 66/152

[58] Field of Search ..... 26/80, 83, 84, 26/85, 51, 71, 101, 99; 66/149 R, 150, 151, 152, 153; 38/70, 102.8; 112/63

[56] References Cited

U.S. PATENT DOCUMENTS

| | | | |
|---|---|---|---|
| 1,113,905 | 10/1914 | Pease . | |
| 1,736,387 | 11/1929 | Barratt | 66/151 |
| 2,251,222 | 7/1941 | Cloutier | 66/153 |
| 2,321,010 | 6/1943 | Cohn | 112/63 |
| 2,450,932 | 10/1948 | Beard . | |
| 2,503,524 | 4/1950 | Stubblebine . | |
| 2,553,074 | 5/1951 | Beard . | |
| 2,652,615 | 9/1953 | Lasley . | |
| 2,668,324 | 2/1954 | Johnson | 26/80 |
| 2,773,296 | 12/1956 | Cohn et al. . | |
| 3,162,028 | 12/1964 | Egerton et al. . | |
| 3,218,829 | 11/1965 | Seiler . | |
| 3,402,444 | 9/1968 | Merrill . | |
| 3,672,249 | 6/1972 | Sasaki . | |
| 3,701,315 | 10/1972 | Maund . | |
| 3,922,765 | 12/1975 | Hogendyk . | |
| 4,014,187 | 3/1977 | Bandoch et al. . | |
| 4,314,462 | 2/1982 | Ducol et al. . | |
| 4,473,929 | 10/1984 | Green . | |
| 5,425,251 | 6/1995 | Schmid et al. | 66/149 R |
| 5,535,535 | 7/1996 | DuFour . | |
| 5,701,641 | 12/1997 | Catallo | 26/80 |
| 5,960,647 | 10/1999 | Fan | 66/151 |

FOREIGN PATENT DOCUMENTS

| | | | |
|---|---|---|---|
| 519315 | 2/1931 | Germany | 26/83 |

*Primary Examiner*—Amy Vanatta
*Attorney, Agent, or Firm*—Alston & Bird LLP

[57] ABSTRACT

A tubular knit fabric descending from a knitting head is spread and flattened by a fabric spreader disposed within the fabric just above a pair of take-down rolls forming a nip through which the fabric passes. The spreader comprises a generally flat frame formed by tubular members. The tubular members include a pair of U-shaped sections having open ends spaced apart and facing each other, and having closed ends defining opposite fabric-engaging edge surfaces of the frame. First legs of the U-shaped sections are telescopingly and adjustably joined to a tubular center section, the center section and first legs collectively forming a roll-engaging member for pressing the fabric against the take-down rolls. The width of the spreader is adjusted by releasing screws fixing the center section to the U-shaped sections, sliding the U-shaped sections inward or outward, and using the screws to fix the frame at the new width. The roll-engaging member preferably has a diameter of about 70 to about 100 percent of the diameter of the take-down rolls. Fabric tension can be varied by adding weight to or removing weight from the interior of the roll-engaging member.

23 Claims, 2 Drawing Sheets

APPARATUS AND METHOD FOR SPREADING AND FLATTENING A TUBULAR FABRIC

FIELD OF THE INVENTION

The invention relates to circular knitting machines and, more particularly, to apparatus and methods for use in a take-down unit of a circular knitting machine for spreading and flattening the tubular knit fabric formed in the machine.

BACKGROUND OF THE INVENTION

A wide variety of devices are known for spreading and flattening a tubular knit fabric in a circular knitting machine. U.S. Pat. No. 2,553,074 issued to Beard, U.S. Pat. No. 2,652,615 issued to Lasley, and U.S. Pat. No. 3,402,444 issued to Merrill all disclose such devices.

The Beard patent discloses an adjustable tubular fabric spreader formed as a U-shaped frame having a rounded nose or bight portion and a pair of opposed limbs or arms that are generally parallel. The ends of the arms are respectively joined to transversely extending sleeves, which in turn are telescopically slidable in the ends of a main sleeve or handle that forms part of a turnbuckle means. Reinforcing stay rods are connected between the sleeves and the bight portion of the U-shaped frame. Rotation of the handle operates the turnbuckle means and thus permits adjustment in the distance between the ends of the arms, thereby adjusting the width of the spreader. The turnbuckle means for adjusting the width of the spreader is relatively complicated.

The Lasley patent discloses an opening shoe for opening and detwisting a tubular fabric such as is necessary after wet processing of the tubular fabric in rope form so that the fabric can be passed through the nip between a pair of stop rolls. The shoe is formed by plate members presenting flat top and bottom shoe faces, and a tubular frame to which the plate members are secured, so that the tubular frame presents rounded edges. The fabric encloses the shoe and the shoe and fabric tube are supported in a horizontal orientation by a roll and the stop rolls. Thus, the weight of the shoe does not contribute toward fabric tension in Lasley's device. Furthermore, the shoe is of fixed geometry. Lasley's shoe also would have a relatively high center of gravity when used in a vertical position and thus may be prone to instability in a rotating circular knitting machine take-down unit.

The Merrill patent discloses a tubular fabric spreader frame or divider unit disposed within the tubular web for maintaining the web width substantially constant just prior to the passing of the web between a pair of rolls. The divider unit includes a first frame member having a vertical member that extends along the fabric movement direction and has a horizontal hollow sleeve joined perpendicularly to the vertical member at a lower end thereof. A second frame member is formed similarly to the first frame member and has a vertical member and a horizontal member joined to a lower end thereof and configured to be slidably received in the sleeve of the first frame member. A third frame member is resiliently biased with respect to the second frame member and includes a horizontal member slidably disposed within a bracket that is mounted on the vertical member of the second frame member. The width of the divider unit is adjustable by operating a friction latch that is mounted on a pair of horizontal members attached to the first frame member and that engages another horizontal member attached to the second frame member, such that the horizontal member on the second frame member slides relative to the sleeve. The tubular fabric is spread by the first and third frame members, and by virtue of the resilient biasing of the third frame member, the divider unit is said to exert a proper degree of tension to maintain the web at a predetermined width. Merrill's divider unit would have a relatively high center of gravity and thus may be prone to instability when used in a rotating circular knitting machine. Moreover, the divider unit is quite complicated in its construction.

SUMMARY OF THE INVENTION

The present invention provides apparatus and methods for spreading and flattening a tubular fabric employing a fabric spreader that is relatively simple and low-cost in its construction, is light in weight, and has good stability in operation. The fabric spreader in preferred embodiments also is adjustable in width for accommodating tubular fabrics of different diameters or achieving different degrees of spreading of a fabric. Additionally, in still further preferred embodiments of the invention, the weight of the fabric spreader is readily adjustable for varying a tension of the fabric leading into take-down rolls of a take-down unit.

To these ends, a fabric spreader in accordance with a preferred embodiment of the invention comprises a generally flat frame formed by a pair of generally U-shaped sections having spaced-apart open ends facing each other and having closed ends defining opposite fabric-engaging edge surfaces of the spreader. A first leg of one of the U-shaped sections is joined with a corresponding first leg of the other U-shaped section so as to form a roll-engaging member adapted to engage the fabric against the take-down rolls. The spreader has a width sized such that, when disposed within the tubular fabric, the spreader engages and spreads the tubular fabric into a generally flattened orientation.

Preferably, the first legs of the U-shaped sections are movably joined to each other so as to allow the length of the roll-engaging member to be adjusted such that the width of the spreader can be adjusted for different tubular fabric diameters. In accordance with a preferred embodiment, the first legs of the U-shaped sections are telescopingly joined to a center section that extends between the U-shaped sections, the center section and first legs collectively defining the roll-engaging member of the spreader. Advantageously, the U-shaped sections and center section are tubular, and the center section and first legs of the U-shaped sections are slidably received one within another, and the spreader further includes fixing members for fixing the center section relative to the U-shaped sections. The fixing members are releasable to allow the U-shaped sections to slide relative to the center section for adjusting the width of the spreader. The fixing members advantageously comprise threaded fasteners, and the center section and first legs include holes for receiving the threaded fasteners. The center section preferably includes a plurality of holes spaced lengthwise therealong such that the position of the center section can be adjusted to a plurality of positions relative to at least one of the U-shaped sections.

Preferably, each U-shaped section has a second leg having a terminal end that extends along a direction defining an angle of about 0° to about 40° relative to a lengthwise direction of the first leg. The overall height of the spreader preferably is substantially smaller than its width in order to contribute toward a relatively low center of gravity of the spreader, thus improving stability of the spreader.

Stability of the spreader is further enhanced, and undesirable pinching or interference between the spreader and the take-down rolls is reduced or eliminated, by configuring the spreader such that the diameter of the roll-engaging member is about 70 to about 100 percent of the diameter of the take-down rolls. Accordingly, the invention also provides a method of spreading and flattening a tubular fabric that descends vertically from a knitting head of a circular knitting machine to a pair of take-down rolls each having a predetermined diameter and forming a nip therebetween through which the fabric is passed after being spread and flattened. The method comprises guiding the tubular fabric along a generally vertical path toward the take-down rolls, disposing a generally flat spreader within the tubular fabric above the take-down rolls, the spreader having opposite fabric-engaging edge surfaces configured to spread the tubular fabric into a generally flattened configuration, the spreader further including an elongate member having an outer diameter between about 70 percent and about 100 percent of the diameter of the take-down rolls, and allowing the spreader to float freely within the tubular fabric in a position having the elongate member of the spreader engaging the fabric against the take-down rolls.

A further aspect of the invention is the provision of methods and apparatus for varying the tension in the fabric leading into the take-down rolls of a take-down unit. Accordingly, a method in accordance with a preferred embodiment of the invention includes disposing a spreader having an elongate member within the tubular fabric descending vertically toward a pair of take-down rolls such that gravity urges the spreader downward and the elongate member engages the fabric against the take-down rolls, and varying a tension in the fabric leading into the take-down rolls by varying the weight of the spreader so as to vary a pressure between the elongate member and the take-down rolls. A spreader is also provided that allows the weight of the spreader to be readily varied. Preferably, such a spreader includes a hollow member for engaging the fabric against the take-down rolls, the hollow member being adapted to have one or more weights disposed therein. Thus, the weight of the spreader can be varied by adding or removing one or more weights from the interior of the hollow member.

BRIEF DESCRIPTION OF THE DRAWINGS

The above and other objects, features, and advantages of the invention will become more apparent from the following description of certain preferred embodiments thereof, when taken in conjunction with the accompanying drawings in which.

DETAILED DESCRIPTION OF THE DRAWINGS

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

Figure 1:
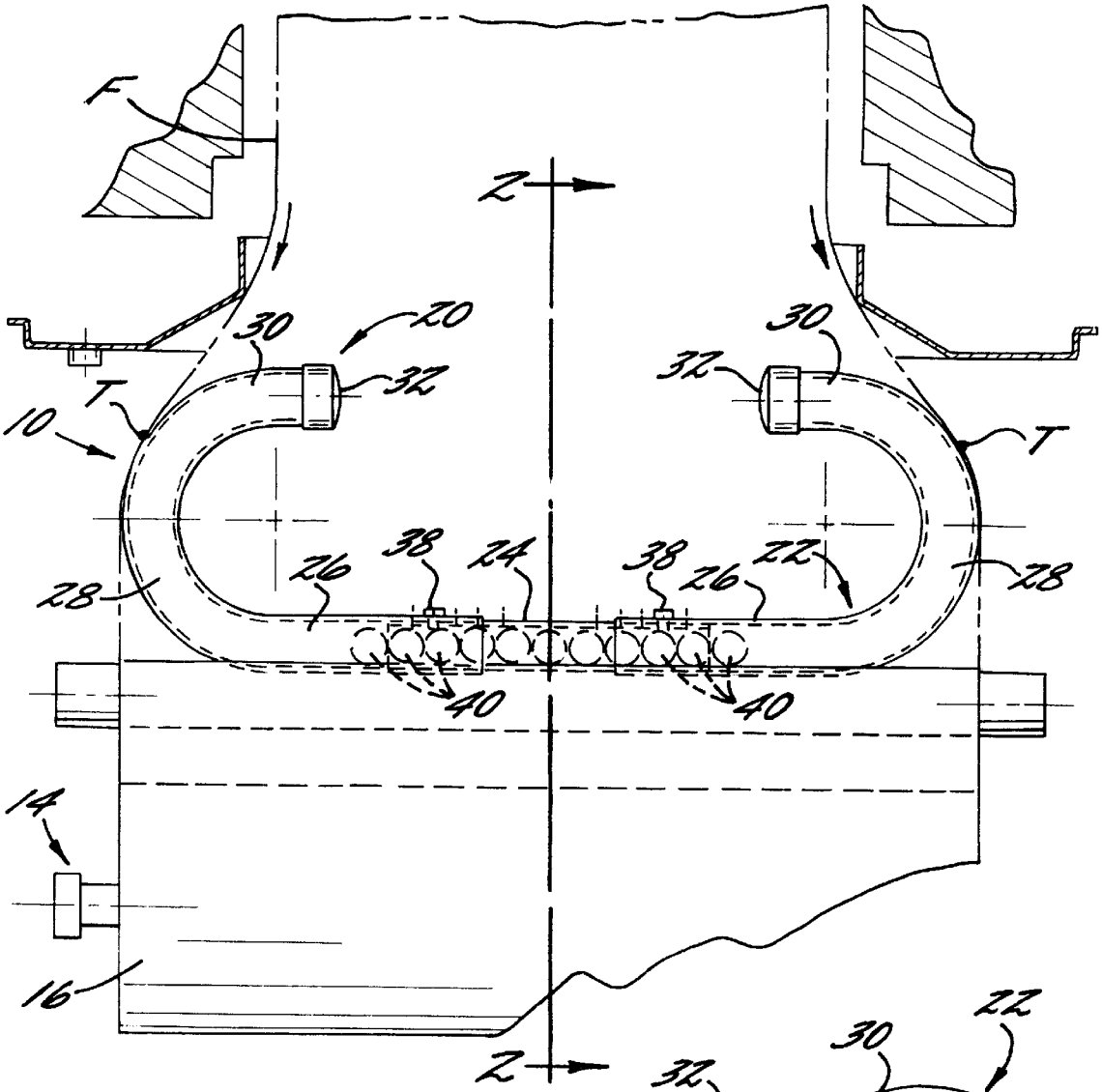
FIG. 1 is a front elevation of a take-down unit for a circular knitting machine in accordance with a preferred embodiment of the invention.
Figure 2:
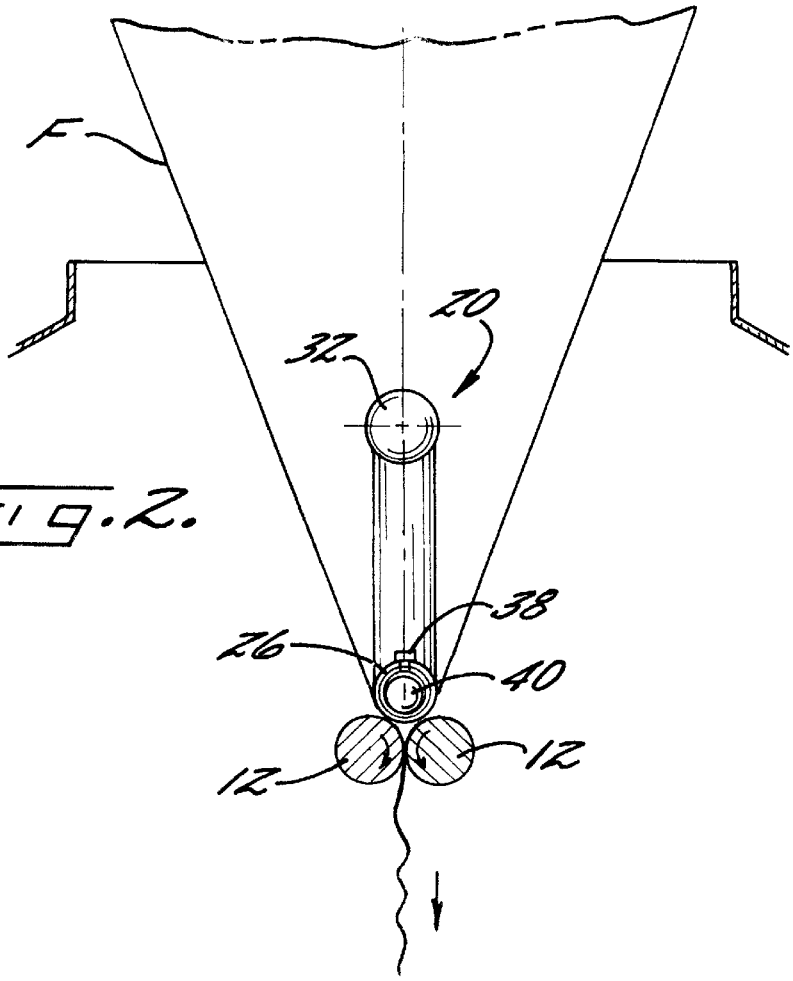
FIG. 2 is a cross-sectional view taken on line 2—2 of FIG. 1.

FIG. 1 depicts a front elevational view and FIG. 2 depicts a cross-sectional view of a take-down unit 10 for a circular knitting machine in accordance with one preferred embodiment of the invention. A tubular knit fabric F is formed by a knitting head (not shown) and descends therefrom along a generally vertical path. A pair of horizontally mounted take-down rolls 12 are disposed vertically below the knitting head in the path of the fabric. The take-down rolls 12 form a nip through which the fabric F is passed after being spread and shaped into a generally flattened condition. The fabric F is flattened by the take-down rolls 12 into a double-thickness web, which is then passed to further equipment. In the manufacture of some types of fabrics, such as yarn knits, the fabric after passing through the take-down rolls may be wound into a roll 16 with the use of a winder 14 (FIG. 1). In other types of fabrics, such as sliver knits, the fabric descends unaided by any further rollers or the like after passing through the take-down rolls 12 (FIG. 2).

Figure 3:
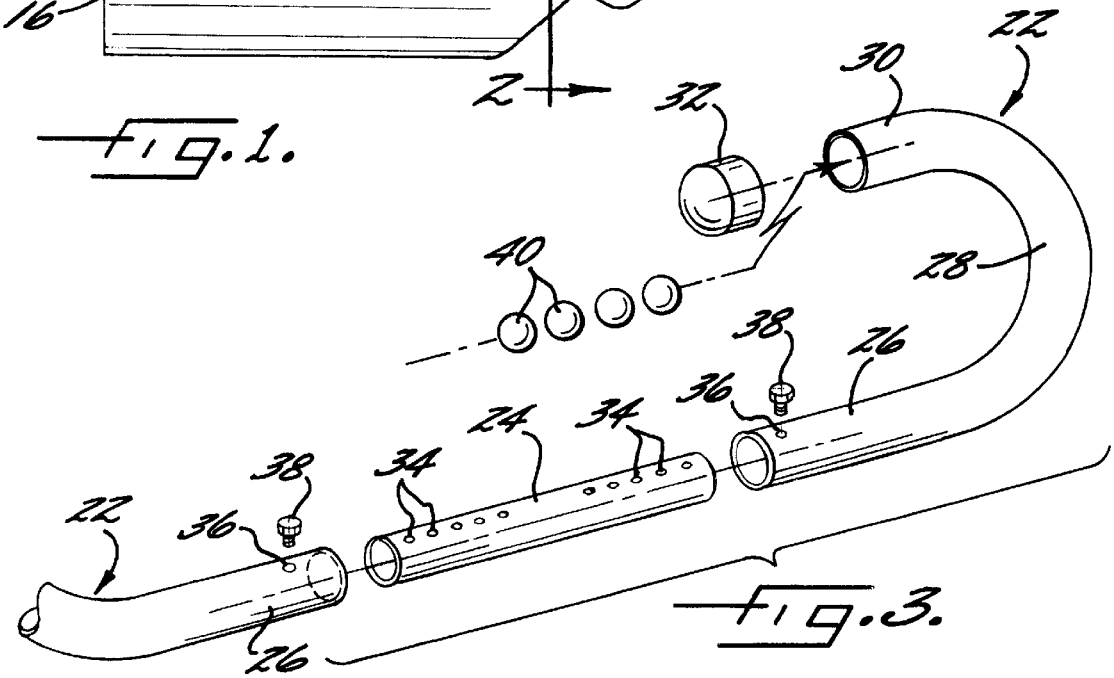
FIG. 3 is a fragmentary exploded perspective view of a spreader in accordance with a preferred embodiment of the invention.

The fabric F is shaped into the generally flattened condition for passage between the take-down rolls 12 by a free-floating fabric spreader 20 disposed within the tubular fabric. With reference to FIGS. 1 and 3, the spreader 20 is formed by two U-shaped sections 22 and a straight center section 24. The two U-shaped sections 22 advantageously can be identical to each other. Each U-shaped section 22 is formed from tubular stock, such as thin-walled metal tubing, that is bent into the U-shaped configuration. The U-shaped sections 22 each includes a first leg 26 that is substantially straight, an arcuate portion 28 having a lower end joined to an outer end of the first leg 26, and a second leg 30 joined to an upper end of the arcuate portion 28. If desired, the open terminal ends of the second legs 30 can be closed by caps or plugs 32. The outer surfaces of the U-shaped sections 22 and center section 24 should have a smooth surface finish, and are preferably chrome plated and/or polished.

The center section 24 has an outer diameter slightly smaller than the inner diameter of the first legs 26. The opposite ends of the center section 24 are slidably received in the open inner ends of the first legs 26, and the U-shaped sections 22 are oriented to lie in the same plane such that the spreader 20 forms a generally flat frame, as shown in FIG. 2. It will of course be recognized that instead of having the center section 24 received within the first legs 26, alternatively the center section 24 could be made to have an inner diameter slightly larger than the outer diameter of the first legs 26 and the first legs 26 could be received within the opposite ends of the center section 24.

The center section 24 includes a series of holes 34 spaced along its length. Preferably, the holes 34 are distributed symmetrically on either side of a midpoint of the center section. Each of the first legs 26 includes a hole 36 located on an upper surface thereof (i.e., the surface facing the second leg 30), the holes 36 preferably being equally spaced from the inner ends of the first legs. A fixing member in the form of a threaded fastener or screw 38 extends through each hole 36 and into one of the holes 34 in the center section for fixing the center section 24 so that it cannot slide relative to the U-shaped sections 22. The width of the spreader 20 thus can be adjusted by removing or loosening the screws 38 so that they clear the holes 34 in the center section, sliding the U-shaped sections 22 outward or inward to align different holes 34 with the holes 36 in the first legs 26, and replacing or retightening the screws 38. Preferably, for optimum balance, the spreader 20 should be symmetrical about the midpoint of the center section 24 so that the center of gravity of the spreader lies substantially on the line of symmetry passing through the midpoint. To this end, an equal length of the center section 24 should be received within each of the first legs 26. The symmetric distribution of the holes 34 and the equal spacing of the holes 36 from the inner ends of the first legs make this possible.

The spreader 20 preferably has a height H that is substantially smaller than its width W in order to achieve a relatively low center of gravity of the spreader. A low center of gravity tends to improve the stability of the spreader in use, particularly when used in a rotating circular knitting machine wherein inertial forces can be imposed on the spreader. To further lower the center of gravity, the second legs 30 preferably should be as short as practicable. As shown in FIG. 1, the fabric F becomes tangent to outer fabric-engaging surfaces of the arcuate portions 28 of the U-shaped sections 22 at points T. Preferably, the arcuate portions 28 extend inwardly from the tangent points T, and in the embodiment of the invention shown in FIGS. 1 and 3 the bend in the arcuate portions 28 is about 180°. However, it is not always necessary for the bend in the arcuate portions 28 to be a full 180°.

Figure 4:
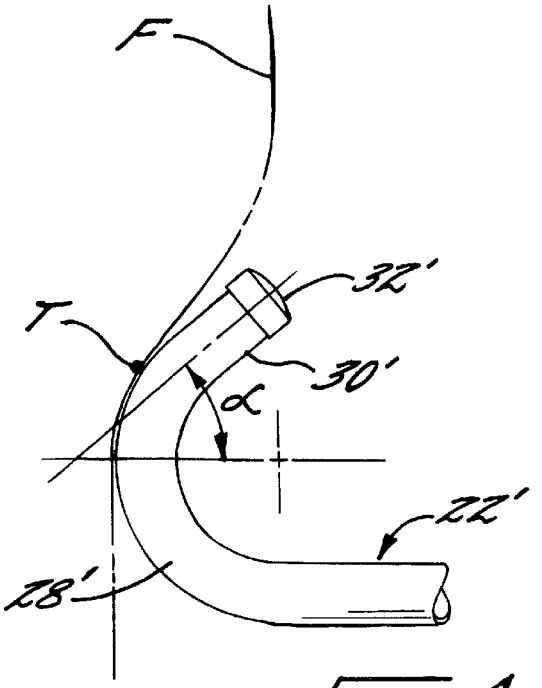
FIG. 4 is a fragmentary front elevation of a spreader in accordance with another preferred embodiment of the invention.

FIG. 4 depicts an alternative embodiment of a spreader in fragmentary view showing only the outer portion of one U-shaped section 22', it being understood that the spreader is otherwise the same as that of FIGS. 1 and 3. As made clear by FIG. 4, the arcuate portion 28' can be bent less than 180° while still ensuring that the U-shaped section 22 extends inward of the tangent point T. Advantageously, the second leg 30' makes an angle $\alpha$ of about 0° to 40° relative to the first legs 26, and thus the bend in the arcuate portion 28' can be as small as about 140°. The second leg 30' preferably extends inwardly only far enough to ensure that its end is free of the fabric, thereby ensuring that the U-shaped sections 22' present smooth surfaces for engaging the fabric.

In use, and as shown in FIGS. 1 and 2, the spreader 20 is disposed within the fabric F supported only by the fabric and by the take-down rolls 12 against which gravity urges the spreader. The first legs 26 and center section 24 collectively form a generally cylindrical member that rests upon the take-down rolls 12 with the fabric interposed between and pressed by the cylindrical member and rolls. Thus, a three-point contact occurs between the take-down rolls 12 and the fabric F: the fabric is pressed in the nip, and is also pressed between each roll 12 and the cylindrical member of the spreader 20. Without the spreader 20, the nip pressure on the fabric would have to be relatively high in order to create sufficient frictional force on the fabric to prevent the fabric from slipping back toward the knitting head of the machine. High pressure on the fabric is undesirable from the standpoint of fabric quality. With the use of the spreader 20, however, the resultant three-point contact allows sufficient frictional force to be generated with less normal pressure on the fabric, because the total contact area of the rolls 12 with the fabric is much greater.

The spreader 20 also enables the fabric tension leading into the take-down rolls 12 to be reduced relative to a take-down unit without the spreader. Additionally, the spreader 20 enables the fabric tension to be varied. To this end, one or more weights 40 such as steel balls, steel rods, or other types of weights, can be placed inside the center section 24 and/or in the first legs 26, and the weight of the spreader 20 can be varied by adding or removing one or more of the weights 40. The pressure exerted between the spreader 20 and the take-down rolls 12 is directly proportional to the weight of the spreader 20, and the fabric tension is directly related to this pressure. Accordingly, by varying the weight of the spreader 20, the fabric tension can be varied.

It will be recognized that when the spreader 20 is adjusted as previously described so as to increase the width of the spreader above its minimum width, as shown for example in FIG. 1, the inner ends of the first legs 26 of the U-shaped sections 22 are spaced a distance apart. In the center area between the inner ends of the first legs 26, the roll-engaging member of the spreader is formed by the center section 24, which has a smaller diameter than the first legs 26. Accordingly, the fabric is pressed against the take-down rolls 12 with a lesser pressure in the center area compared with the pressure exerted by the first legs 26. However, this is acceptable because the outer edge portions of the fabric are generally under greater tension than the center portion leading into the take-down rolls 12 as a result of the greater distance from the knitting area to the rolls 12 that must be traveled by the outer edge portions relative to the center portion. Thus, it is normal for the center portion to have a lower tension, and the center section 24 of the spreader 20 is capable of providing adequate tension despite its lesser diameter. In this regard, it is considered preferable to have the center section 24 slidably received into the U-shaped sections 22 rather than having the U-shaped sections slidably received into the center section.

The diameter of the first legs 26 and center section 24 must be suitably chosen in relation to the diameter of the take-down rolls 12 if optimum performance is to be obtained. Preferably, to prevent binding or interference between the spreader 20 and the rolls 12, the diameter of the spreader tubing should be at least about 70 percent of the diameter of the rolls 12. If the diameter of the tubing is made substantially less than this value, damage to the take-down system can occur. Furthermore, the stability of the spreader 20 can deteriorate if the diameter of the tubing is too large in relation to the diameter of the rolls 12. Preferably, for satisfactory stability, the tubing diameter should not exceed about 100 percent of the diameter of the rolls 12.

A configuration that has been found to be satisfactory includes take-down rolls 12 having a diameter of about 2.1 inches, and U-shaped sections 22 formed from tubing having an outer diameter of 1.75 inches. The wall thickness of the tubing forming the U-shaped sections 22 is 0.065 inch. The center section 24 is formed from tubing having an outer diameter of 1.62 inches and a wall thickness of about 0.12 inch. The center section 24 has a length of about 11 inches. The maximum width W of the spreader 20 when the screws 38 are engaged in the outermost holes 34 of the center section 24 is about 30 inches; the minimum width when the screws are in the innermost holes 34 is about 25 inches. The height H of the spreader 20 is about 10 inches. The arcuate sections 28 of the U-shaped sections 22 are formed as circular arcs having a radius of about 3.5 inches measured at the centerline of the tubing. The spreader 20 preferably has a weight of about 5 pounds. Of course, the spreader can have different dimensions and weight depending on the diameter of the tubular fabric and other factors. The spreader can be used with a variety of fabric types such as sliver knit, yarn knit, jersey fabrics, and others.

Many modifications and other embodiments of the invention will come to mind to one skilled in the art to which this invention pertains having the benefit of the teachings presented in the foregoing descriptions and the associated drawings. For example, the spreader 20 is described as having a roll-engaging member of circular cross-section, but it is not essential for the cross-section to be circular, although it is advantageous for at least the portion of the member that engages the take-down rolls to be generally circular-arc in shape. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A fabric spreader for spreading and flattening a tubular knit fabric formed in a circular knitting machine in which the tubular fabric descends vertically from a knitting head of the machine to a pair of take-down rolls forming a nip through which the flattened fabric is passed, the fabric spreader comprising:

a generally flat frame formed by a pair of generally U-shaped sections having spaced-apart open ends facing each other and having closed ends defining opposite fabric-engaging edge surfaces of the spreader, a first leg of one of the U-shaped sections being joined with a corresponding first leg of the other U-shaped section so as to form a roll-engaging member adapted to engage the fabric against the take-down rolls, the spreader having a width between the opposite edge surfaces thereof such that the spreader when disposed within the tubular fabric engages and spreads the tubular fabric into a generally flattened orientation.

2. The fabric spreader of claim 1, wherein the first legs of the U-shaped sections are movably joined to each other so as to allow the length of the roll-engaging member to be adjusted such that the width of the spreader can be adjusted.

3. The fabric spreader of claim 2, wherein the first legs of the U-shaped sections are telescopingly joined to a center section that extends between the U-shaped sections, the center section and first legs collectively defining the roll-engaging member of the spreader.

4. The fabric spreader of claim 3, wherein the U-shaped sections and center section are tubular.

5. The fabric spreader of claim 4, further comprising at least one weight disposed within the roll-engaging member for increasing the weight of the spreader.

6. The fabric spreader of claim 4, wherein the center section and first legs of the U-shaped sections are slidably received one within another, and further comprising fixing members for fixing the center section relative to the U-shaped sections, the fixing members being releasable to allow the U-shaped sections to slide relative to the center section for adjusting the width of the spreader.

7. The fabric spreader of claim 6, wherein the fixing members comprise threaded fasteners, and wherein the center section and first legs include holes for receiving the threaded fasteners.

8. The fabric spreader of claim 7, wherein the center section includes a plurality of holes spaced lengthwise therealong such that the position of the center section can be adjusted to a plurality of positions relative to at least one of the U-shaped sections.

9. The fabric spreader of claim 1, wherein each U-shaped section has a second leg having a terminal end that extends along a direction defining an angle of about 0° to about 40° relative to a lengthwise direction of the first leg.

10. A method of spreading and flattening a tubular fabric that descends vertically from a knitting head of a circular knitting machine to a pair of take-down rolls each having a predetermined diameter and forming a nip therebetween through which the fabric is passed after being spread and flattened, the method comprising:

guiding the tubular fabric along a generally vertical path toward the take-down rolls;

disposing a generally flat spreader within the tubular fabric above the take-down rolls, the spreader having opposite fabric-engaging edge surfaces configured to spread the tubular fabric into a generally flattened configuration, the spreader further including an elongate member having an outer diameter between about 70 percent and about 100 percent of the diameter of the take-down rolls; and allowing the spreader to float freely within the tubular fabric in a position having the elongate member of the spreader engaging the fabric against the take-down rolls.

11. The method of claim 10, further comprising varying the weight of the spreader so as to vary a tension of the fabric passing into the nip between the take-down rolls.

12. The method of claim 11, wherein the elongate member is hollow, and wherein varying the weight of the spreader comprises adding a weight to or removing a weight from an interior of the elongate member.

13. The method of claim 10, wherein disposing the spreader within the tubular fabric comprises disposing a spreader formed by a pair of generally U-shaped sections having spaced-apart open ends facing each other and having closed ends defining opposite fabric-engaging edge surfaces of the spreader, a first leg of one of the U-shaped sections being joined with a corresponding first leg of the other U-shaped section so as to form the elongate member adapted to engage the fabric against the take-down rolls.

14. The method of claim 10, further comprising providing the spreader having a height measured along the direction of the path of the fabric that is substantially smaller than a width of the spreader measured between the opposite fabric-engaging edge surfaces, whereby the spreader has a low center of gravity.

15. A method of spreading and flattening a tubular fabric that descends vertically from a knitting head of a circular knitting machine to a pair of take-down rolls forming a nip therebetween through which the fabric is passed after being spread and flattened, the method comprising:

guiding the tubular fabric along a generally vertical path toward the take-down rolls;

disposing a generally flat spreader within the tubular fabric above the take-down rolls, the spreader having opposite fabric-engaging surfaces configured to spread the tubular fabric into a generally flattened configuration, the spreader further including an elongate roll-engaging member;

allowing the spreader to float freely within the tubular fabric such that gravity urges the spreader downward and the roll-engaging member engages the fabric against the take-down rolls; and varying a tension in the fabric leading into the take-down rolls by varying the weight of the spreader so as to vary a pressure between the roll-engaging member and the take-down rolls.

16. The method of claim 15, further comprising providing the spreader having the roll-engaging member formed as a hollow member, and wherein the weight of the spreader is varied by adding one or more weights to or removing one or more weights from an interior of the hollow member.

17. An apparatus for spreading and flattening a tubular knit fabric descending along a vertical path, comprising:

a pair of take-down rolls disposed horizontally in the path of the fabric and forming a nip for passage of the fabric therethrough; and a fabric spreader adapted to be disposed within the tubular fabric above the take-down rolls for spreading the fabric into a generally flattened condition prior to the fabric passing through the nip, the fabric spreader comprising a generally flat frame formed by a pair of generally U-shaped sections having spaced-apart open ends facing each other and having closed ends defining opposite fabric-engaging edge surfaces of the spreader, a first leg of one of the U-shaped sections being joined with a corresponding first leg of the other U-shaped section so as to form a roll-engaging member adapted to engage the fabric against the take-down rolls, the spreader having a width between the opposite edge surfaces such that the spreader when disposed within the tubular fabric engages and spreads the tubular fabric into a generally flattened condition.

18. The apparatus of claim 17, wherein the take-down rolls have equal predetermined diameters, and the roll-engaging member of the spreader is cylindrical and has an outer diameter between about 70 and about 100 percent of the roll diameter.

19. The apparatus of claim 17, wherein the roll-engaging member is hollow, and further comprising at least one weight disposed within the roll-engaging member for increasing the weight of the spreader.

20. The apparatus of claim 17, wherein the first legs of the U-shaped sections are movably joined to each other so as to allow the length of the roll-engaging member to be adjusted such that the width of the spreader can be adjusted for different tubular fabric diameters.

21. The apparatus of claim 20, wherein the first legs of the U-shaped sections are telescopingly joined to a center section that extends between the U-shaped sections, the center section and first legs collectively defining the roll-engaging member of the spreader.

22. The apparatus of claim 17, wherein the U-shaped sections and center section are tubular.

23. The apparatus of claim 22, wherein the center section and first legs of the U-shaped sections are slidably received one within another, and further comprising fixing members for fixing the center section relative to the U-shaped sections, the fixing members being releasable to allow the U-shaped sections to slide relative to the center section for adjusting the width of the spreader.

* * * * *